US005235725A

United States Patent [19]

Rees

[11] Patent Number: 5,235,725

[45] Date of Patent: Aug. 17, 1993

[54] CLOSURE PANEL HINGE

[75] Inventor: Richard W. A. Rees, Rochester Hills, Mich.

[73] Assignee: ITT Corporation, New York, N.Y.

[21] Appl. No.: 810,263

[22] Filed: Dec. 19, 1991

[51] Int. Cl.[5] ..... E05F 1/08

[52] U.S. Cl. ..... 16/298; 16/306

[58] Field of Search ..... 16/298, 299, 297, 300, 16/278, 279, 289, 290, 286, 285, 281, 306, 307, 308, 16 C; 180/69.21; 296/76

[56] References Cited

U.S. PATENT DOCUMENTS

| | | | |
|---|---|---|---|
| 2,272,230 | 2/1942 | Van Voorhees | 16/306 |
| 2,308,759 | 1/1943 | Joachin | 16/306 |
| 2,547,550 | 4/1951 | Whitmore | 16/298 |
| 2,612,651 | 10/1952 | Roethel | 16/306 |
| 2,698,957 | 1/1955 | Vigmostad | 16/306 |
| 2,703,430 | 3/1955 | Thomas et al. | 16/306 |
| 3,019,473 | 2/1962 | Bogater | 16/289 |
| 3,921,252 | 11/1975 | Guth | 16/281 |
| 5,050,270 | 9/1991 | Burgei et al. | 16/298 |

*Primary Examiner*—Lowell A. Larson
*Assistant Examiner*—Michael J. McKeon
*Attorney, Agent, or Firm*—Robert P. Seitter; J. Gordon Lewis

[57] ABSTRACT

A hinge pivotally moves a closure panel between two positions to open and close an access opening formed in a structure. The hinge includes a mounting plate connected to the structure. A strap is pivotally connected at a first end to the mounting plate and is fixedly connected at a second end to the closure panel. A clock biasing spring is connected at a first end to the mounting plate and has a second end rotationally and radially movable with respect to the first end. A link is pivotally connected at a first end to the strap at a position spaced from the pivot connection of the first end of the strap to the mounting plate. A second end of the link is pivotally connected to the second end of the spring to transmit biasing force from the spring to the strap and the attached closure panel to effect movement of the closure panel at a controlled rate depending upon the force moment created by the angle between the link and a line extending through the center of the biasing spring and the connection point of the second ends of the link and the spring and/or between the second of the link and the first pivot connection of the strap to the mounting plate.

20 Claims, 4 Drawing Sheets

CLOSURE PANEL HINGE

BACKGROUND OF THE INVENTION

1. Field of the Invention

The present invention relates, in general, to hinges and, more specifically, to vehicle closure panel hinges.

2. Background Description

Automotive vehicles have one or more deck lids, such as a trunk lid, which typically use a hinging device incorporating two torsion bars extending between two hinges mounted on the vehicle and connected to one end of two straps. The other ends of the straps are connected to the closure panel or deck lid. The torsion bars counter-balance the weight of the deck lid and enable the deck lid to be more easily moved between raised and lower positions.

This hinge construction requires that the torsion bars and the strap hinges or pivot connections be assembled on the vehicle separately. Due to the location of the torsion bars below the rear shelf of the vehicle, installation and service of the torsion bars and the hinges is difficult and time consuming. Furthermore, two workers acting in concert are needed to attach the torsion bars between the two strap pivots or hinges which further adds to assembly time.

A deck lid hinge using torsion bars also creates packaging difficulties within the vehicle trunk since the torsion bars extend transversely across the trunk. The torsion bars take up space within the trunk and interfere with other vehicle components, such as the sound system speakers mounted on the parcel shelf. Further, torsion bars are noisy in operation, are sensitive to alignment, and do not perform particularly well due to high internal friction. As a result, the hinge counter-balance function is often times reduced to a brake which holds the deck lid open at any arbitrary position or is so powerful that it causes the deck lid to rise uncontrollably to its maximum opening position where it slams into stops, vibrating the entire vehicle and can even deform the sheet metal of the vehicle. The torsion bar hinge assembly is costly in terms of the number of separate components required for its assembly and its lengthy installation time. Further, the torsion bars are heavy which is a disadvantage in view of the desirability of reducing weight in current vehicles for increased fuel economy.

In order to increase available trunk space, the space below the parcel shelf where the torsion bars are typically mounted is being further limited. Finally, deck lids are becoming increasingly heavier due to added tail lamp assemblies, trunk and luggage racks, and spoilers thereby requiring higher counter-balance spring forces which results in larger and more costly torsion bars.

Other hinge arrangements have also been developed to overcome the above-described problems associated with the use of torsion bar hinge assemblies. In one such hinge assembly shown in FIG. 9 and used on a vehicle deck lid, a mounting plate 1 attached to a stationary vehicle structure, such as the rear parcel shelf, supports a clock spring 2 formed in a number of loops about a spring center 3 fixed to the mounting plate. A first link 4 is connected between the spring center 3 and the free end 5 of the spring 2 to retain the spring coil or loop at a constant radius during rotation of the free end 5 of the spring 2 as the deck lid is raised and lowered. At least one and, preferably, a pair of spaced drive links 6 are connected between the free end 5 of the spring 2 and a strap 7 which is pivotally connected at one end to the mounting plate 1 and fixed at another end to the vehicle deck lid. While this hinge assembly overcomes a large number of the problems associated with the use of torsion bar hinge assemblies used in automotive vehicles, this arrangement provides a fixed force versus spring position curve which limits the design of the hinge for different deck lid weights and different deck lid opening/closing profiles.

Thus, it would be desirable to provide a closure panel hinge which overcomes the aforementioned problems involved in closure panel hinges, particularly those employed for automotive vehicle closure panels. It would also be desirable to provide a closure panel hinge which can be advantageously employed as a vehicle deck lid hinge and which reduces hinge weight, space requirements and installation time as compared to previously-devised vehicle deck lid hinges. Finally, it would be desirable to provide a closure panel hinge which can be easily designed to provide any spring force versus closure panel position profile thereby adapting the hinge to a wide variety of different applications and different modes of operation.

SUMMARY OF THE INVENTION

The present invention is a hinge for a closure panel which controls the movement of the closure panel between two positions, such as raised and lowered positions, with respect to an opening in a surrounding structure.

The hinge includes a mounting plate which is fixedly attachable to a structure surrounding an opening formed in the structure. In one exemplary application, the hinge is mounted in an automotive vehicle and controls the movement of a vehicle closure panel, such as a deck lid, between raised and lowered positions to open and close an access opening in a vehicle compartment, such as a vehicle trunk. A strap having first and second ends is pivotally connected at the first end to the mounting plate. The second end of the strap is fixedly attachable to the closure panel. Biasing means in the form of a spring having first and second ends and wound in a plurality of turns about the first end is connected at the first end to the mounting plate. The second end of the biasing means is rotationally and radially movable with respect to the fixed first end. A link is pivotally connected at a first end to the strap at a position spaced from the pivotal connection of the first end of the strap to the mounting plate. A second end of the link is pivotally connected to the second end of the spring. The link has a length which creates a variable moment arm depending on the angular position of the link which varies the force exerted by the biasing spring on the strap to control the movement of the strap and the attached closure panel between raised and lowered positions.

Stop means may be provided at either or both of the full open or full closed positions of the closure panel. The stop means, in one exemplary embodiment of the present invention, comprises a resilient pad mounted on the mounting plate which engages the strap when the strap reaches the full open position.

In a preferred embodiment, the link is sized so as to be disposed at an angle of substantially 150° with respect to a line extending through the center of the spring and the connection between the second ends of the link and the spring when the closure panel is in the fully raised position. This creates a force moment which acts on the closure panel, when the closure panel is in the fully raised position, to maintain the closure panel in the fully raised position with sufficient force to resist inadvertent lowering of the closure panel. Similarly, when the closure panel approaches the closed position, the link can be designed so as to be disposed substantially in line with the first end portion of the strap. This places the first end of the strap in tension and removes any spring force acting on the strap. This can enable the hinge of the present invention, when employed on a vehicle deck lid, to have a substantially reduced or even negligible spring force so as to enable the deck lid to be easily repositioned when in the fully closed position into flush alignment with the surrounding body structure before the mounting plate is tightened into fixed engagement with the fixed vehicle structure.

The geometry of the link and the interaction of the link and the biasing spring may be varied to provide any spring force versus closure panel position profile. This would enable, for example, the closure panel to spring upward a short distance when an initial opening force is exerted on the panel, with the closure panel remaining in the slightly raised position. Alternately, the geometry of the hinge may also be varied to provide an automatic, controlled rise of the closure panel to its fully raised position or to enable the closure panel to be arbitrarily left in any desired position between the fully raised and fully lowered position. Lastly, it is possible to have a substantially higher force acting on the closure panel at the full open position than through the mid range positions to act as a safety feature.

The hinge of the present invention is also provided with unidirectional spring force adjustment means which enables the spring force to be varied, particularly during installation of the hinge and closure panel to a surrounding structure, such as a vehicle. In a preferred embodiment, the unidirectional, spring force adjustment means comprises a serrated washer having a plurality of radially extending, angularly disposed teeth formed on the periphery thereof. The serrated washer is disposed between a flange on the mounting plate and a second flat washer which is fixedly mounted on a rotatable nut extending through and receiving the first end of the spring. The nut may be rotated in one direction to increase the force generated by the spring, with the serrations on the serrated washer sliding over the face of the cooperating flat washer. Rotation of the spring in the opposite direction which would tend to decrease the spring force is prevented by engagement of the angularly disposed teeth on the serrated washer with the flat washer.

This spring force adjustment means simplifies the construction of the hinge as compared to previously-devised hinges by substantially reducing the number of separate components required for the hinge; while at the same time providing the desired variable adjustment of the spring force.

The hinge of the present invention overcomes many of the problems associated with previous hinges, particularly those utilizing torsion bars for vehicle closure panels. The hinge of the present invention is formed of a minimum number of components for a low manufacturing cost. At the same time, the hinge can be easily installed to a fixed structure, such as a vehicle, by a single operator, without requiring cooperation with another worker as necessary with previously devised vehicle closure panel hinges utilizing torsion bars. The hinge of the present invention, due to the low number of components, has a reduced weight and consumes less space in the fixed structure, which, in vehicle applications, is particularly advantageous. Furthermore, the hinge is easily serviced. The hinge of the present invention may also be easily modified to provide any spring force versus closure panel position profile so as to enable its use on many different closure panel applications and to accommodate various force versus closure panel position profiles, closure panel weights, etc.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
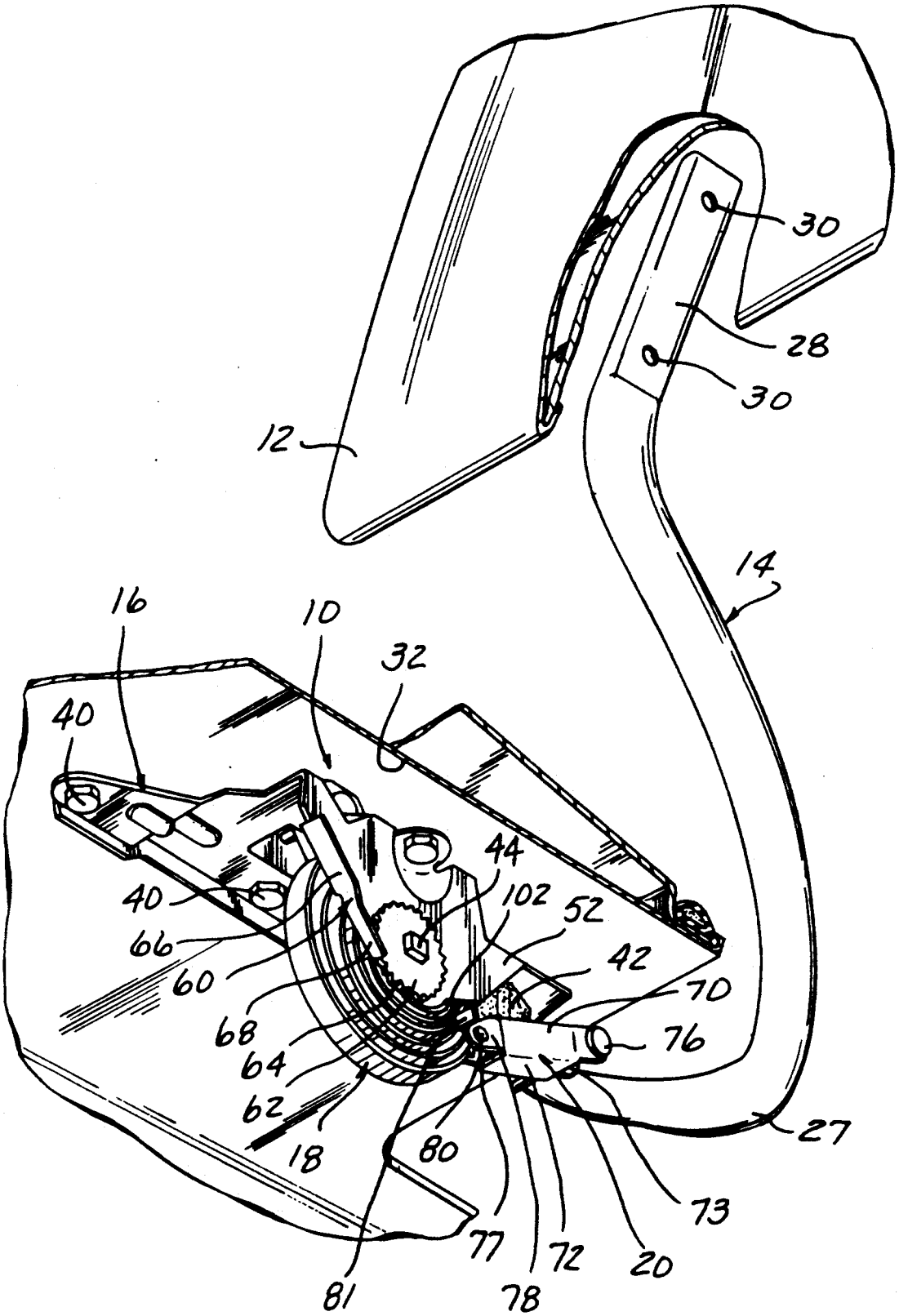
FIG. 1 is a perspective view of the hinge of the present invention.

Referring now to the drawing, and to FIG. 1 in particular, there is depicted a hinge 10 which functions to pivotally move an attached closure panel 12 between first and second positions. The hinge 10 is particularly suited for use with an automotive vehicle closure panel, such as a deck lid, hood, etc. It will be understood that the following description of the hinge 10 of the present invention as employed in an automotive vehicle and with a vehicle closure panel 12, such as a deck lid, is by way of example only as the hinge 10 of the present invention may also be advantageously employed in other applications, such as garage doors, freezer lids, etc.

The hinge 10 shown in FIG. 1, when employed in an automotive vehicle in association with a vehicle closure panel 12, such as a deck or trunk lid, is used as one of a pair of substantially identical hinges mounted in a spaced apart location on the vehicle. In the exemplary application, the function of the hinge 10 is to control the pivotal movement of the closure panel 12 between a raised position exposing an access opening in the vehicle to allow access to a vehicle compartment, such as a trunk, and a closed position wherein the closure panel 12 encloses the access opening and is disposed in substantially flush alignment with exterior body panels surrounding and forming the vehicle compartment or trunk opening.

The hinge 10 includes a minimal number of components, such as a hinge strap 14, a mounting plate 16, a biasing means 18 and a drive link 20. Each of these components will be described in greater detail hereafter.

Figure 2:
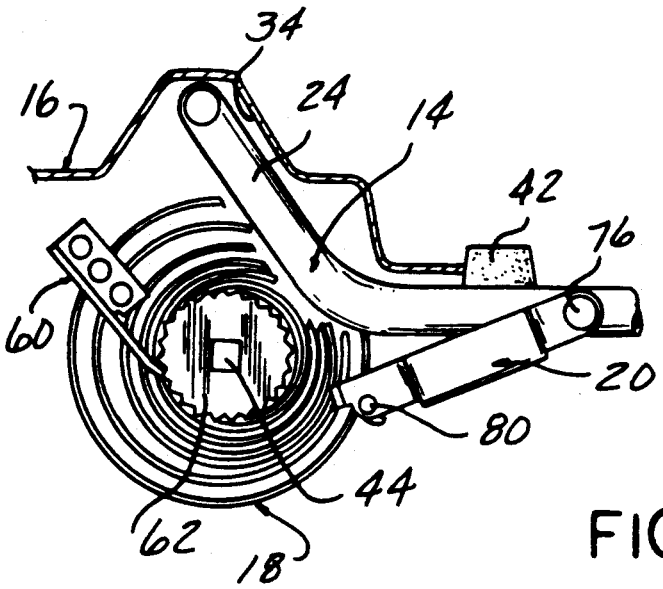
FIG. 2 is a side-elevational view of a portion of the hinge shown in FIG. 1, with the hinge arranged to deploy the closure panel in the fully raised position.
Figure 3:
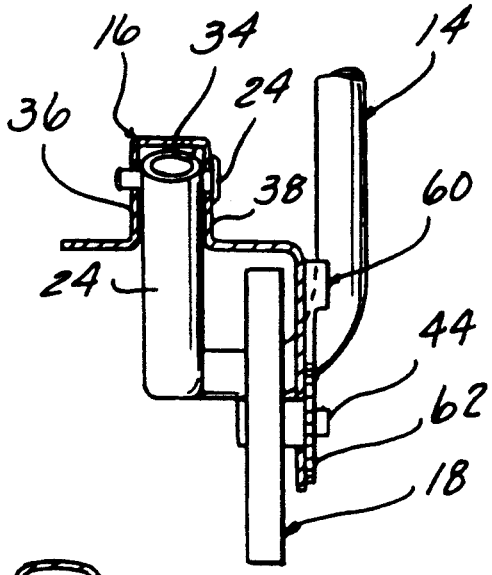
FIG. 3 is a plan view of the portion of the hinge shown in FIG. 2.

The hinge strap 14 is in the form of an elongated, bent member which may be in the form of a hollow tube, or an elongated, generally flat strap. The strap 14 is formed into any desired shape consistent with the requirements of a particular application and the surrounding structure. The strap 14 includes a first end 24, as shown in FIGS. 2 and 3, which is pivotally connected to the mounting plate 16 by means of a suitable pivot pin 26 which extends through aligned apertures in spaced wall portions of the mounting plate 16 and apertures in the first end 24 of the strap 14. In the exemplary application as a vehicle deck lid hinge, the strap 14 has a generally U-shaped bend 27 formed between the first end 24 and a spaced second end 28. The shape of the bend 27 can be modified, as needed, to provide a particular fully raised position of the closure panel 12 as well as to avoid interference with surrounding vehicle structure.

As shown in FIG. 1, the second end 28 of the strap 14 is fixedly connected to the closure panel or deck lid 12. Any connection means may be employed, such as welding, fasteners, etc. Preferably, apertures 30 are formed in the second end 28 of the strap 14 and receive fasteners which extend through spaced portions of the deck lid 12 to fixedly connect the second end 28 of the strap 14 to the deck lid 12.

The mounting plate 16 preferably comprises a formed member having any particular configuration suitable for fixed attachment to the vehicle structure, such as to the rear parcel shelf 32 of an automotive vehicle. The configuration of the mounting plate 16 shown in FIGS. 1–5 is exemplary only and may be modified to suit any particular vehicle configuration and to place the location of the pivot connection between the first end 24 of the strap 14 and the mounting plate 16 at any desired location as needed for a particular open position of the closure panel or deck lid 12.

Thus, the mounting plate 16 has a centrally located raised portion 34 which extends upward from the plane of the first and second ends of the mounting plate 16. The central, raised portion 34, as shown in FIG. 3, also includes spaced sidewalls 36 and 38 which have aligned apertures formed therein for receiving the strap pivot pin 26, as described above.

As is well-known, slots, apertures and clearance holes may be formed at various locations in the mounting plate 16 for receiving fasteners 40, as shown in FIG. 1, for fixedly securing the mounting plate 16 to vehicle body structure, such as the rear parcel shelf 32 of a vehicle.

As shown in FIGS. 1–5, a stop means 42 in the form of a resilient cushion or pad is mounted at one end of the mounting plate 16. The cushion or stop means 42 may also be mounted at any other location on the mounting plate 16 as required to cushion the upward movement of the closure panel 12.

Figure 4:
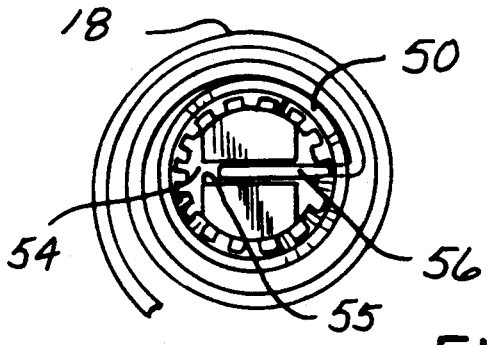
FIG. 4 is a partial side elevational view of the spring of the present hinge.

The biasing means 18 of the hinge 10 is preferably in the form of a clock spring formed as a flat member wound in a plurality of loops about a spring center denoted by reference number 44 in FIG. 1. A hub 50, shown in FIG. 4, extends through the center of the spring coil 18 and through an aperture formed in a sidewall 52 in the mounting plate 16. A rotatable nut 54 is disposed within the hub 50 and extends therethrough. A transverse slot 55 is formed at one end of the nut 54 and fixedly receives a first end 56 of the spring 18 therein. The spring 18 is then wound in a plurality of loops about the nut 54 and hub 50 as shown in FIG. 4.

The amount of force generated by the biasing spring 18 may be selected by the thickness and width of the strip material used to form the spring 18, as well as the number and tightness of the windings of the coils or loops of the spring 18 about the spring center 44.

By way of background, unidirectional spring force adjustment means denoted in general by reference number 60 in FIG. 1 is mounted on the sidewall 52 of the mounting plate 16 and interacts with the spring 18 to enable the force generated by the spring 18 to be adjusted as needed for a particular application. The adjustment means 60 preferably comprises a ratchet 62 in the form of a planar disc rotatably mounted about the hub 50 on an exterior surface of the sidewall 52 of the mounting plate 16. The ratchet 62 is formed with a plurality of angularly disposed, peripheral, radially extending teeth 64. A pawl 66 is fixedly connected by suitable fastening means, such as rivets, to the mounting plate 16. The pawl 66 has an exterior end 68 which engages the teeth 64 on the ratchet 62. The teeth 64 on the ratchet 62 are disposed so as to enable the ratchet 62 to be rotated in one direction whereby the teeth 64 slide easily over the end 68 of the pawl 66. However, rotation of the ratchet 62 and the hub 50, the nut 54 and the first end 56 of the spring 18 in an opposite direction is prevented due to the fixed engagement between the end 68 of the pawl 66 and one tooth 64 on the ratchet 62. The adjustment means 60 enables the force of the spring 18 to be increased to a desired amount to overcome variations in spring force created during the manufacture of the spring 18 or the assembly of the spring 18 on the vehicle, especially where the same hinge 10 may be expected to adjust for options, such as luggage racks, extra insulation, etc., mounted on the closure panel 12.

The drive link 20 of the hinge 10 may have any particular shape. By way of example only, the drive link 20 is in the form of a U-shaped member having a pair of spaced sidewalls, both denoted by reference number 70 in FIGS. 1 and 5, which are interconnected on one end by a central wall 72. At one end of the link 20, the ends of the sidewalls 70 extend outward from one end 73 of the central wall 72 to form a pair of spaced ears 74. Aligned apertures are formed in each of the ears 74 and receive one end of a pin 76 therethrough. The other end of the pin 76 is fixedly connected, such as by welding, to the strap 14 at a position spaced from the pivot connection of the first end 24 to the mounting plate 16 by the pivot pin 26 shown in FIG. 3.

At the other end of the link 20, the sidewalls 70 likewise extend outward from a second end 77 of the central wall 72 to form a pair of spaced ears 78. Aligned apertures are also formed in the ears 78 and receive a pin 80 therethrough. The pin 80 is secured to the link 20 by suitable means, such as by welding. The second end 82 of the spring 18 pivotally engages the pin 80 to pivotally connect the second end of the link 20 to the second end 82 of the spring 18. The ears 78 on the link 20 are bent outward to form flanges 81, the purpose of which will be described in greater detail hereafter.

The link 20 connects the spring 18 to the strap 14 and transmits the force of the spring 18 to the strap 14 to effect raising and lowering of the strap 14 and the attached closure panel 12 through a predetermined spring force versus closure panel 12 position profile. The second end of the link 20 pushes on the second end 82 of the spring 18 and, depending upon the angular position of the link 20 with respect to the spring 18 and the strap 14, causes the loops of the spring 18 to move both rotationally and radially with respect to the spring center 44. This rotational and radial movement of the spring 18 with respect to its center 44, provides a variably adjustable moment arm in conjunction with the link 20 which varies the force exerted by the spring 18 on the strap 14 depending upon the angular orientation of the link 20 with respect to the spring center 44 and the strap 14. This moment arm may be varied by varying the length of the link 20 and/or the position of the point of connection of this link 20 to the first end to the strap 14.

The hinge 10 of the present invention may be modified or designed to provide any spring force versus closure panel 12 position profile so as to provide, for example, a maximum force to the hold the closure panel 12 in the fully opened position, to provide a controlled, uniform, automatic rising of the closure panel 12 from the fully closed to the fully opened position, or to enable the closure panel 12 to be arbitrarily placed at any desired position between the fully opened and fully closed position. In addition, the hinge 10 can be designed so as to remove substantially all of the spring force or load on the strap 14 when the closure panel 12 is in the fully closed position. This is particularly advantageous in vehicle assembly operations since the hinge 10 can be loosely connected to the vehicle body structure and the closure panel 12 disposed in its fully closed position thereby enabling a worker to easily move the closure panel 12 in the opening in the vehicle, such as the trunk opening, to bring the closure panel 12 in even and flush alignment with the surrounding body structure.

FIG. 2 depicts the location of the components of the hinge 10 when the closure panel 12 is in its fully raised position. In this position, the link 20 and the location of the stop pad 42 have been designed so as to dispose the link 20 at an obtuse angle between the longitudinal axis of the link 20 extending between the pivot pin 76 and 80 at opposite ends of the link 20 and a line extending through the spring center 44 and the pin 80 at the second end of the link 20. This angle is optimally 150°. Angles greater or less than 150°, but less than 180°, may also be provided by changing the length of the link 20 or by repositioning the stop 42, or by engaging one of the flanges 81 formed on the first end of the link 20 with an edge 102 of the mounting plate 16 to stop further rotation of the link 20 and the strap 14 at the desired position.

In the position shown in FIG. 2, the link 20 forms a moment arm which transmits sufficient force from the spring 18 to the strap 14 and the attached closure panel 12 to retain the closure panel 12 in the fully raised position despite any inadvertent forces which would tend to lower the closure panel 12, such as gusts of wind, etc. This may be described as a detent position and can occur at the closed position of the closure panel 12 as well. However, due to the angular arrangement of the link 20 and the spring 44, as described above, the closure panel 12 may be easily lowered by user force on the closure panel 12.

Figure 6:
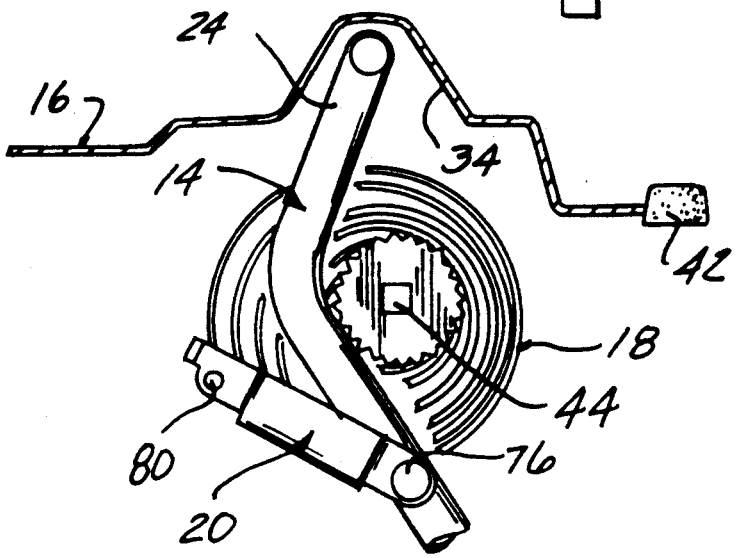
FIG. 6 is a side-elevational view showing the position of the components of the hinge when the closure panel has been moved toward, the partially closed position.

During such lowering of the closure panel 12, the link 20 pushes the second end 82 of the spring 18 in a curved path about the spring center 44. This path includes both rotational and radial components. The force transmitted from the spring 18 by the link 20 may be selected so as to provide a detent position, as shown in FIGS. 2 and 6, which is located just before the closure panel 12 reaches the fully raised or lowered position, respectively. In the position depicted in FIG. 6, the link 20 and its angular position with respect to the strap 14 is designed to generate a moment of sufficient force to equal the weight of the closure panel 12 so as to bring the strap 14 to a stationary position just before the fully closed position of the closure panel 12. This detent position would enable, for example, an automatic trunk closure mechanism to engage the closure panel 12 to forcibly pull the closure panel 12 to its fully closed position.

Figure 7:
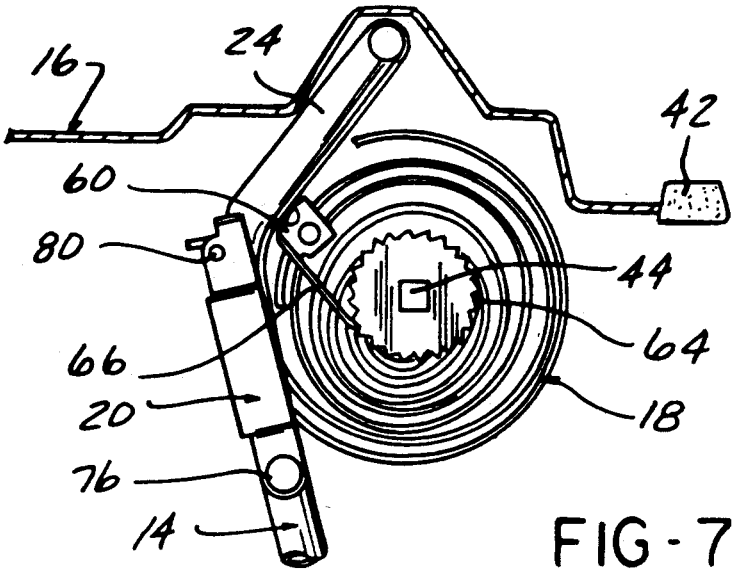
FIG. 7 is a side-elevational view of the hinge showing the position of the components of the hinge when the closure panel is in the fully closed position.
Figure 9:
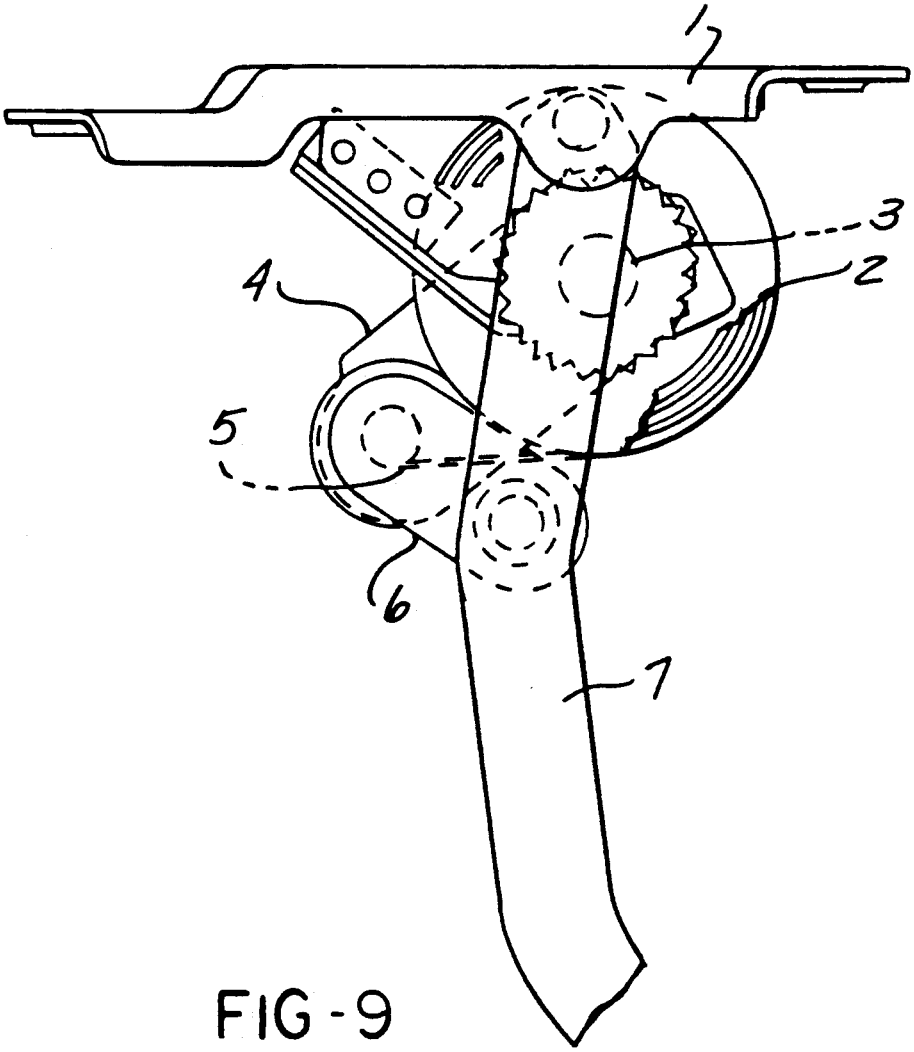
FIG-9 PRIOR ART
FIG. 9 is an elevational view of a prior art deck lid hinge.

Alternately, as shown in FIG. 7, the hinge 10 could be designed so as to automatically effect a full closure of the closure panel 12. In this configuration, user force lowering the closure panel 12 to the closed position will cause the second end of the link 20 to push the second end 82 of the spring 18 about the spring center 14 to the position shown in FIG. 7. In this position, a flange 81 at one end of the link 20 can be made to engage a portion or edge of the mounting plate 16 to stop further rotation of the link 20. However, the link 20 has achieved a substantially in-line position with respect to the strap 14. This removes all spring force 18 acting to pivot the strap 14 about its first end 24 and places the first end 24 of the strap 14 in tension. This enables the closure panel 12 to be repositioned during assembly into a final position in flush alignment with the surrounding vehicle structure.

Referring again to FIG. 6, the detent position described above could also be employed as an initial rise position for the closure panel 12. When the closure panel 12 is released, such as by activating a closure panel lock, the angular position of the link 20 with respect to the second end 82 of the spring 18 and the strap 14 will provide a moment having sufficient force to raise the closure panel 12 a short distance, such as one-half to one inch above the fully closed position. The closure panel 12 will remain in this position until the user exerts a further upward force thereon. The link 20 could be designed so as to effect an automatic, uniform, constant raising of the closure panel 12. The link 20 could also be designed in terms of its geometry to substantially equally counter-balance the spring force so as to enable closure panel 12 to be positioned at any desired angular position between the fully raised and fully closed position.

Figure 10:
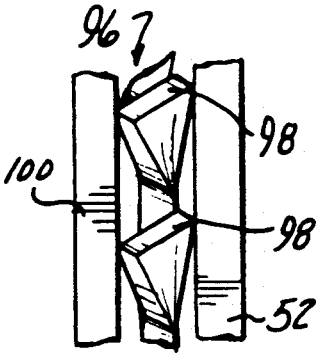
FIG. 10 is an enlarged view of a portion of FIG. 8.
Figure 5:
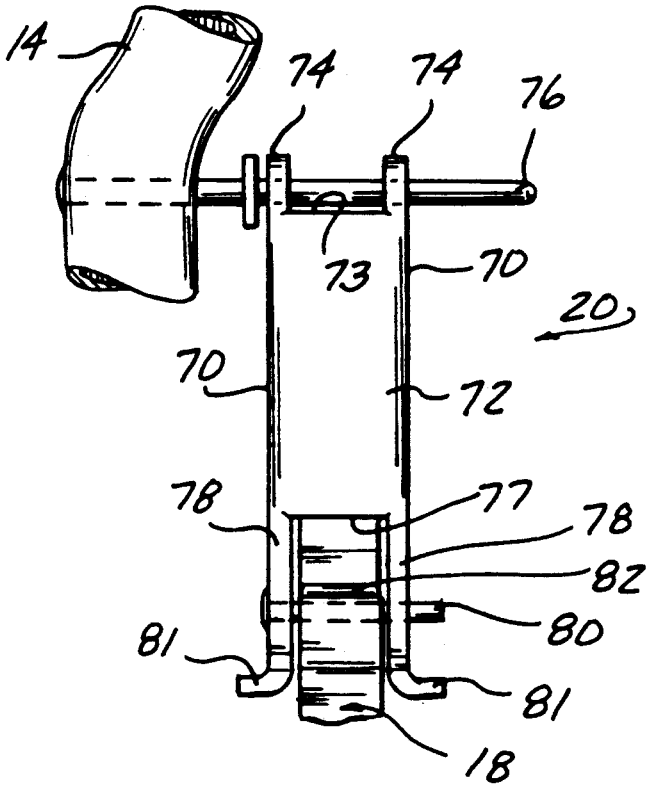
FIG. 5 is a partial front elevational view of the link of the present hinge.
Figure 8:
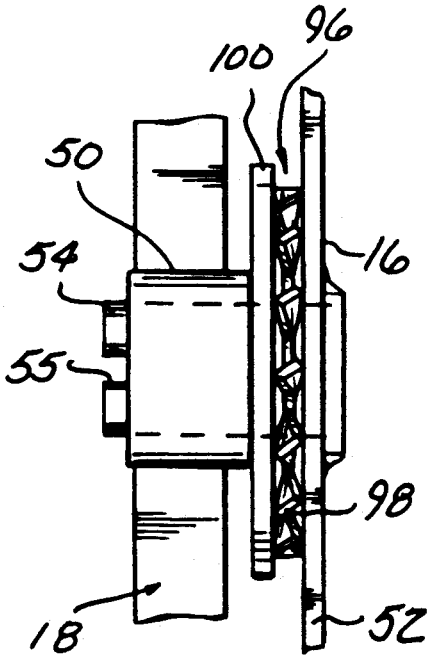
FIG. 8 is an end view of the spring force adjustment means shown in FIG. 6.

Referring now to FIGS. 8 and 10, there is depicted an alternate embodiment of the spring force adjustment means. In this embodiment, the ratchet 62 and pawl 60 are replaced by a serrated washer 96 which has a generally planar, annular configuration with a plurality of angularly oriented, radially extending teeth 98 formed about its periphery. The serrated washer 96 is mounted about the nut 54 which extends through the hub 80 centrally within the spring 18. The serrated washer 98 is disposed in registry with the sidewall 52 of the mounting plate 16 on one side and in registry with a smooth washer 100 on the opposite side. The smooth washer 100 fixedly engages the hub 50. The teeth 98 on the serrated washer 96 are angularly arranged so as to enable the serrated washer 96 to be rotated in one direction in which the angular teeth 98 slide over the surface of the washer 100, without substantially engaging the washer 100. However, rotation of the washer 96 in an opposite direction is resisted due to the forced engagement of the teeth 98 with the washer 100. In this manner, the nut 54 may be rotated in one direction to increase the force of the spring 18 and automatically locked in the desired position by the serrated washer 96. Rotation of the nut 54 in an opposite direction is resisted due to the engagement of the teeth 98 of the serrated washer 96 with the smooth washer 100. This arrangement provides an adjustable spring force lock means with a minimum number of components.

In summary, there has been disclosed a unique hinge for pivotally moving a closure panel between two positions. The hinge of the present invention is constructed of a minimal number of components for a low manufacturing cost, reduced weight and ease of installation. The hinge of the present invention is ideally suited for use in an automotive vehicle to control the pivotal movement of a vehicle closure panel, such as a deck lid, hood, etc. In this application, the hinge provides a controlled movement of the closure panel between raised and lowered positions with respect to a vehicle compartment, such as a trunk. The hinge may be easily modified to provide any desired spring force versus closure panel position profile to vary the opening and closing movements of the closure panel as needed for a particular application, closure panel weight, etc.

What is claimed is:

1. A hinge apparatus for a pivotal closure panel movable between first and second positions to open and close an opening in a compartment, the compartment formed by a fixed structure surrounding and forming the opening, the hinge apparatus comprising:

a mounting plate fixedly attachable to the structure surrounding the opening in the compartment;

a strap having first and second ends, the first end being pivotally connected to the mounting plate, the second end of the strap being fixedly attachable to the closure panel;

a biasing spring having first and second ends and wound in a plurality of turns about the first end, the first end of the spring being connected to the mounting plate, the second end of the spring being rotationally and variably radially movable with respect to the first end; and a single link having first and second ends, the first end of the link being pivotally connected to the strap at a position spaced from the pivotal connection of the first end of the strap to the mounting plate, the second end of the link being pivotally connected to the second end of the spring and movable therewith, the link having a predetermined selectable length to generate a variable moment arm depending on the angle between an axis extending between the first and second ends of the link and an axis extending between a center of the spring and the connection of the second end of the link to the second end of the spring to vary the force exerted by the biasing spring on the strap to control the movement of the strap between the first and second positions.

2. The hinge apparatus of claim 1 further comprising:

means for stopping rotation of the link at a first angular position as the closure panel approaches the first position, with the axis extending between the first and second ends of the link disposed at a predetermined angle with respect to the axis extending through a center of the biasing spring and the connection between the second end of the biasing spring and the second end of the link such that the link transmits force from the biasing spring to maintain the closure panel in the first position.

3. The hinge apparatus of claim 2 wherein the rotation stopping means comprises a stop mounted on the mounting plate and engaging the link at a predetermined angular position of the link.

4. The hinge apparatus of claim 3 wherein the predetermined angular position of the link is at an angle substantially 150° between the axis extending between the first and second ends of the link and an axis extending through the center of the biasing spring and the connection between the end of the biasing spring and the second end of the link.

5. The hinge apparatus of claim 2 wherein the rotation stopping means comprises:

first flange means, mounted on the link, for engaging the mounting plate at a selected angular position of the link.

6. The hinge apparatus of claim 2 wherein the rotation stopping means further comprises:

means for stopping rotation of the link at a second angular position with respect to the strap as the closure panel approaches the second position.

7. The hinge apparatus of claim 6 wherein the rotation stopping means comprises:

second flange means, mounted on the link, for engaging the mounting plate as the link reaches the second angular position.

8. The hinge apparatus of claim 1 further comprising:

spring force adjustment means, coupled to the biasing spring, for allowing rotation of the first end of the biasing spring in only one direction to vary the spring force; while preventing rotation of the first end of the spring in the opposite direction.

9. The hinge apparatus of claim 8 wherein the spring force adjustment means comprises:

a serrated washer having a plurality of angularly disposed, radially extending teeth formed on the periphery thereof, the serrated washer fixedly engaging the mounting plate;

a pin having the first end of the biasing spring connected thereto, the pin extending through the biasing spring and rotatingly extending through the serrated washer and the mounting plate; and a second planar washer non-rotatingly mounted on the pin and disposed in registry with the serrated washer such that the angular teeth on the serrated washer are rotatable over the second washer when the pin and the second washer are rotated in one direction, but engage the second washer to resist rotation of the second washer, the pin and the biasing spring in an opposite direction.

10. A hinge apparatus for a pivotal closure panel movable between the first and second positions to open and close an opening in a compartment, the compartment formed by a fixed structure surrounding and forming the opening, the hinge apparatus comprising:

a mounting plate fixedly attachable to the structure surrounding the opening in the compartment;

a strap having first and second ends, the first end being pivotablly connected to the mounting plate, the second end of the strap being fixedly attachable to the closure panel;

a biasing spring having first and second ends and wound in a plurality of turns about the first end, the first end of the spring being connected to the mounting plate, the second end of the spring being rotationally and variably radially movable with respect to the first end; and a single link having first and second ends, the first end of the link being pivotally connected to the strap at a position spaced from the pivotal connection of the first end of the strap to the mounting plate, the second end of the link being pivotally connected to the second end of the spring and movable therewith, the link having a predetermined selectable length to generate a variable moment arm depending on the angle between an axis extending between the first and second ends of the link and an axis extending between a center of the spring and the connection of the second end of the link to the second end of the spring to vary the force exerted by the biasing spring on the strap to control the movement of the strap between the first and second positions;

means for stopping rotation of the link at a first angular position as the closure panel approaches the first position, with the axis extending between the first and second ends of the link disposed at a predetermined angle with the axis extending through the center of the biasing spring and the connection between the second end of the spring and the second end of the link such that the link transmits force from the biasing spring to maintain the closure panel in the first angular position; the rotation stopping means including:

a stop mounted on the mounting plate and engaging the link at a predetermined angular position of the link for stopping rotation of the link in one direction; and a flange mounted on the link for engaging the mounting plate as the link reaches a second angular position with respect to the strap as the closure panel approaches the second position;

a serrated washer having a plurality of angularly disposed, radially extending teeth formed on the periphery thereof, the serrated washer fixedly engaging the mounting plate;

a pin having the first end of the biasing spring connected thereto, the pin rotatably extending through the biasing spring and rotatingly engaging the mounting plate, the pin rotatingly carrying the serrated washer thereon; and a second planar washer non-rotatingly mounted on the pin and disposed in registry with the serrated washer such that the angular teeth on the serrated washer are rotatable over the second planar washer when the pin and the second washer are rotated in one direction to allow rotation of the first end of the biasing spring in one direction to increase the spring force, but engage the second washer to resist rotation of the pin and the biasing spring in an opposite direction.

11. In an automotive vehicle having a body structure forming a compartment having an access opening, and a closure panel pivotally mounted to the body structure and movable between raised and lowered positions to open and close the access opening, the hinge apparatus for pivotally mounting the closure to the body structure over the access opening, the hinge apparatus comprising:

first and second hinges connected at spaced locations to the vehicle body structure and the closure panel, each of the first and second hinges comprising:

a mounting plate fixedly attachable to the body structure surrounding the access opening in the compartment;

a strap having first and second ends, the first end being pivotally connected to the mounting plate, the second end of the strap being fixedly attachable to the closed panel;

a biasing spring having first and second ends and wound in a plurality of turns about the first end, the first end of the biasing spring being attached to the mounting plate, the second end of the spring being rotationally and variably radially movable with respect to the first end; and a single link having first and second ends, the first end of the link being pivotally connected to the strap at a position spaced from the pivotal connection of the first end of the strap to the mounting plate, the second end of the link being pivotally connected to the second end of the spring and movable therewith, the link having a predetermined selectable length to generate a variable moment arm depending on the angle between an axis extending between the first and second ends of the link and an axis extending between a center of the spring and the connection of the second end of the link to the second end of the spring to vary the force exerted by the biasing spring on the strap to control the movement of the strap and the attached closure panel between the raised and lowered positions.

12. The hinge apparatus of claim 11 wherein each hinge further comprises:

means for stopping rotation of the link at a first angular position as the closure panel approaches the first position, with the axis extending between the first and second ends of the link disposed at a predetermined angle with respect to the axis extending through a center of the biasing spring and the connection between the second end of the biasing spring and the second end of the link such that the link transmits force from the biasing spring to maintain the closure panel in the first position.

13. The hinge apparatus of claim 12 wherein the rotation stopping means comprises a stop mounted on the mounting plate and engaging the link at a predetermined angular position of the link.

14. The hinge apparatus of claim 13 wherein the predetermined angular position of the link is at an angle of substantially 150° between the axis extending between the first and second ends of the link and an axis extending through the center of the biasing spring and the connection between the second end of the biasing spring and the second end of the link.

15. The hinge apparatus of claim 12 wherein the rotation stopping means comprises:

first flange means, mounted on the link, for engaging the mounting plate at a selected angular position of the link.

16. The hinge apparatus of claim 12 wherein the rotation stopping means further comprises:

means for stopping rotation of the link at a second angular position with respect to the strap as the closure panel approaches a fully closed position.

17. The hinge apparatus of claim 16 wherein the rotation stopping means comprises:

second flange means, mounted on the link, for engaging the mounting plate as the link reaches the second angular position.

18. The hinge apparatus of claim further comprising:

spring force adjustment means, coupled to the biasing spring, for allowing rotation of the first end of the biasing spring in only one direction to vary the spring force; while preventing rotation of the first end of the spring in the opposite direction.

19. The hinge apparatus of claim 18 wherein the spring force adjustment means comprises:

a serrated washer having a plurality of angularly disposed, radially extending teeth formed on the periphery thereof, the serrated washer fixedly engaging the mounting plate;

a pin having the first end of the biasing spring connected thereto, the pin extending through the biasing spring and rotatingly extending through the serrated washer and the mounting plate; and a second planar washer non-rotatingly mounted on the pin and disposed in registry with the serrated washer such that the angular teeth on the serrated washer are rotatable over the second washer when the pin and the second washer are rotated in one direction, but engage the second washer to resist rotation of the second washer, the pin and the biasing spring in an opposite direction.

20. In an automotive vehicle having a body structure forming a compartment having an access opening, and a closure panel pivotally mounted to the body structure and movable between raised and lowered positions to open and close the access opening, a hinge apparatus for pivotally mounting the closure to the body structure over the access opening, the hinge apparatus comprising:

first and second hinges connected at spaced locations to the vehicle body structure and the closure panel, each of the first and second hinges comprising:

a mounting plate fixedly attachable to the structure surrounding the opening in the compartment;

a strap having first and second ends, the first end being pivotally connected to the mounting plate, the second end of the strap being fixedly attachable to the closure panel;

a biasing spring having first and second ends and wound in a plurality of turns about the first end, the first end of the spring being connected to the mounting plate, the second end of the spring being rotationally and variably radially movable with respect to the first end; and a single link having first and second ends, the first end of the link being pivotally connected to the strap at a position spaced from the pivotal connection of the first end of the strap to the mounting plate, the second end of the link being pivotally connected to the second end of the spring and movable therewith, the link having a predetermined selectable length to generate a variable moment arm depending on the angle between an axis extending between the first and second ends of the link and an axis extending between a center of the spring and the connection of the second end of the link to the second end of the spring to vary the force exerted by the biasing spring on the strap to control the movement of the strap between the first and second positions;

means for stopping rotation of the link at a first angular position as the closure panel approaches the first position, with the axis extending between the first and second ends of the link disposed at a predetermined angle with the axis extending through the center of the biasing spring and the connection between the second end of the spring and the second end of the link such that the link transits force from the biasing spring to maintain the closure panel in the first angular position; the rotation stopping means including:

a stop mounted on the mounting plate and engaging the link at a predetermined angular position of the link for stopping rotation of the link in one direction; and a flange mounted on the link for engaging the mounting plate as the link reaches a second angular position with respect to the strap as the closure panel approaches the second position;

a serrated washer having a plurality of angularly disposed, radially extending teeth formed on the periphery thereof, the serrated washer fixedly engaging the mounting plate;

a pin having the first end of the biasing spring connected thereto, the pin rotatably extending through the biasing spring and rotatingly extending through the serrated washer and the mounting plate; and a second planar washer non-rotatingly mounted on the pin and disposed in registry with the serrated washer such that the angular teeth on the serrated washer are rotatable over the second planar washer when the pin and the second washer are rotated in one direction to allow rotation of the first end of the biasing spring in one direction to increase the spring force, but engage the second washer to resist rotation of the second washer, the pin and the biasing spring in an opposite direction.

* * * * *